United States Patent [19]

Ljungkvist et al.

[11] Patent Number: 4,884,384

[45] Date of Patent: Dec. 5, 1989

[54] ARRANGEMENT FOR LAYING CONCRETE FLOORS

[75] Inventors: Stig-Åke Ljungkvist, Skövde; Lennart Johansson, Mariestad, both of Sweden

[73] Assignee: Permaban Southeast, Inc., Matthews, N.C.

[21] Appl. No.: 35,217

[22] Filed: Apr. 6, 1987

Related U.S. Application Data

[63] Continuation of Ser. No. 895,516, Aug. 11, 1986, abandoned, which is a continuation of Ser. No. 795,187, Nov. 15, 1985, abandoned, which is a continuation of Ser. No. 685,600, Dec. 26, 1984, abandoned, which is a continuation of Ser. No. 309,885, filed as PCT SE81/00051 on Feb. 24, 1981, published as WO81/02600 on Sep. 17, 1981, abandoned.

[30] Foreign Application Priority Data

Mar. 4, 1980 [SE] Sweden ..... 8001663-7

[51] Int. Cl.[4] ..... E04G 21/10

[52] U.S. Cl. ..... 52/741; 52/367; 404/119; 404/70

[58] Field of Search ..... 404/68–70, 404/119; 52/741, 318, 367, 729

[56] References Cited

U.S. PATENT DOCUMENTS

| | | | |
|---|---|---|---|
| 83,196 | 10/1868 | Montgomery | 52/729 |
| 662,634 | 11/1900 | White | 52/339 |
| 858,448 | 7/1907 | Gartrell et al. | 52/318 |
| 910,947 | 1/1909 | Needs | 52/723 |
| 1,255,050 | 1/1918 | Quinby | 238/9 |
| 1,369,161 | 2/1921 | Benson . | |
| 1,715,193 | 5/1929 | Galassi | 404/67 |
| 1,756,856 | 4/1930 | Galassi . | |
| 1,772,942 | 8/1930 | Gartenmann | 404/74 |
| 2,023,472 | 12/1935 | Heltzel | 404/83 |
| 2,179,911 | 11/1939 | Wilmoth . | |
| 2,244,297 | 6/1941 | Heltzel | 404/119 |
| 2,425,883 | 8/1947 | Jackson | 52/723 |
| 2,428,562 | 10/1947 | Foulger . | |
| 2,672,295 | 3/1954 | Cone | 404/70 |
| 2,885,939 | 5/1959 | Bartholow et al. | 404/63 |
| 3,616,589 | 11/1971 | Sherard | 52/659 |
| 4,115,976 | 9/1978 | Rohrer | 52/741 |

FOREIGN PATENT DOCUMENTS

| | | | |
|---|---|---|---|
| 664243 | 9/1965 | Belgium | 52/341 |
| 850800 | 9/1952 | Fed. Rep. of Germany . | |
| 1017198 | 10/1957 | Fed. Rep. of Germany . | |
| 1684389 | 1/1970 | Fed. Rep. of Germany . | |
| 2256705 | 5/1973 | Fed. Rep. of Germany . | |
| 755304 | 9/1933 | France | 52/334 |
| 799825 | 4/1936 | France | 404/70 |
| 824751 | 11/1937 | France | 404/50 |
| 545393 | 1/1974 | Switzerland . | |
| 606706 | 11/1978 | Switzerland . | |
| 421293 | 12/1934 | United Kingdom . | |

*Primary Examiner*—James L. Ridgill, Jr.
*Attorney, Agent, or Firm*—Allegretti & Witcoff, Ltd.

[57] ABSTRACT

An arrangement and method for laying concrete floors includes precast concrete, combination concrete-forming and screed-guiding beams. The beams are shaped to provide screed slide faces, anchorage flanges, and as desired, reinforcement bracket projections and dowel opening. The beams are located, leveled and anchored, in a spaced pattern of sections. Concrete reinforcements and dowels are used in the floor area to be laid, as desired. Concrete may be poured in all the sections defined by the beam pattern, and screeded, with the screeds being supported on the beams. The beams are not removed, but hardened into the floor with the poured concrete, eliminating such past, costly practices as temporary screed guide placement and removal, and the required work stoppage and overnight wait for some sections to harden, until adjacent sections can be poured.

7 Claims, 2 Drawing Sheets

ARRANGEMENT FOR LAYING CONCRETE FLOORS

This application is a continuation of Ser. No. 895,516 filed Aug. 11, 1986, now abandoned, which was a continuation of Ser. No. 795,187 filed Nov. 15, 1985, now abandoned, which was a continuation of Ser. No. 685,600, filed Dec. 26, 1984, now abandoned, which was a continuation of Ser. No. 309,885 filed as PCT SE81/00051 on Feb. 24, 1981, published as WO81/02600 on Sep. 17, 1981, now abandoned.

BACKGROUND OF THE INVENTION

1. Field of the Invention

The present invention refers to an arrangement and a method for using this arrangement for laying concrete floors on a hardened base.

2. Description of the Prior Art

Attempting to finds aids and methods for more rational construction is in every way a worthy aim. The procedure adopted for laying concrete floors against a hardened base, for example in factories, department stores, bridges, concrete floors in multi-storey buildings etc, is in principle as follows:

The surface on which the concrete floor is to be laid is divided, is possible, into rectangles of equal size. Half of these, distributed in a chessboard pattern, are laid the first day and the remainder are laid the second day. The reason for this is that the sides bounding these rectangular sections must be used as a screed guide support for the apparatus which is used for levelling and vibrating the applied concrete. Every second section must be given sufficient time to harden before the adjacent sections can be treated in the same way. The arrangement forming boundaries for the sides of the rectangular sections also act as barriers for the freely running concrete.

Before these guide supports are placed in position, certain preparatory work must be carried out. This consists of searching for a suitable material for use as a base for the concrete. The choice of base material is particularly important in, for example, factory buildings with large areas which can be subjected to considerable loads. Sand, which is an easily worked material with satisfactory drainage properties, is often used as a base on which the screed guide supports can be placed so that they are horizontal.

When the screed guides are in position, concreting can be carried out in the first-day rectangles, as described above. The concrete is poured in the rectangles in question and is levelled off manually. A light vibrating screed is then used for distributing and vibrating the concrete. This screed is supported on the screed guide supports which have been set up. When all the first-day rectangles have been processed in the manner described above, work is stopped to give the concrete time to harden until the next day.

The same screed guide supports can be used on the following day for proceeding in an analogous manner. When this work has been carried out, the concrete is permitted to harden until it has achieved sufficient strength to allow the screed guide supports to be removed. The voids thus created must be filled with concrete. This must be permitted to harden before the final treatment of the floor can be started. Such treatment normally embraces grinding and/or filling. Painting or other surface finishing treatment is then usually applied before the floor is taken into use.

This procedure for producing floors does not tally with the aim of rationalizing constructions. The present invention describes an arrangement and a method for avoiding the following troublesome disadvantages which result from the method described above.

Taking two days for concreting is a serious shortcoming in the method which is used today. The need to remove the screed guides and fill the voids which they leave with concrete also constitutes disadvantages. The German published patent application No. 1684389 indicates one means of avoiding this disadvantage by using the reinforcement in the floor to be cast as screed guide supports for the levelling screed. The disadvantage of this method is obvious since metallic objects very easily corrode. This will occur if the method is used and is probably the reason why it has never been generally accepted. It is, in fact very seldom used.

Swiss Pat. No. 545 393 indicates a means of placing prefabricated beams in a grind pattern so that the beams can be used as supports for concrete distributing machines of a type similar to that described above. This method has also been unsuccessful in gaining general acceptance on the market. It is easy to understand why since the beams are heavy and difficullt to handle. The concrete involves a considerable weight in itself and to this must be added the weight of the reinforcement used in the beams. A further disadvantage is that the welded mesh reinforcement, which is usually placed in the concrete to increase the loadbearing capacity of the floor, cannot be fixed in position in a satisfactory manner.

Another shortcoming which affects the current system is that it is difficult to place reinforcement which runs through the various rectangles with the purpose of preventing vertical movements in the finished floor.

SUMMARY OF THE INVENTION

The present invention indicates an arrangement which makes it possible to obtain a rationally produced floor and which completely eliminates the shortcomings mentioned above in the methods currently used for laying floors; the invention also includes instructions for avoiding the shortcomings inherent in the methods presented in the abovementioned patent documents.

FIG. 1 facilitates an understanding of design and mode of use of the present invention. FIG. 1 consists of a cross-section of a loadbearing beam. Light vibrating screeds are run on at least two such beams. The purpose of these screeds is to level and vibrate the concrete which is used in producing the floor. Two such beams are normally used. The other two sides of the abovementioned rectangles can consist of conventional material such as wood planks, concrete walls or the like or of beams of the type referred to in the present invention. One of the advantages offered by this procedure is that dowels can be used and that welded mesh reinforcement can be fastened to the protruding brackets on the beam web. The design of the cross-section presented in FIG. 1 constitutes one example of several possible different designs.

DETAILED DESCRIPTION OF THE PREFERRED EMBODIMENT

Figure 1:
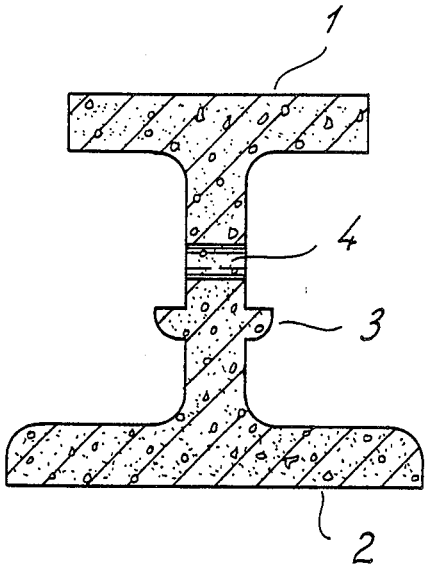
FIG. 1 of the accompanying drawing consists of a cross-section of a load bearing beam according to the invention.

FIG. 1 indicates that the surface 1, which is intended to provide a slide face for the light vibrating screed, is made sufficiently wide to ensure that the screed is carried in a reliable manner. Surface (2), which rests on the base, should preferably be designed in such a way that a sturdy anchorage can be obtained. Vertical holes 4 can, for example, be made in the flanges of this surface so that bolts 5 or screws, for example, can be used for fixing the beam securely to the base. Horizontal holes can be made to take through-going dowels and thus connect two adjacent rectangular sections of concrete. The advantage obtained from this is that the risk of any movements between the sections is reduced.

Welded mesh reinforcement, for example, can be placed on the brackets 3 located on the web so as to increase the strength properties of the floor. The horizontal hole 4 can also be placed on or just below the top edge of the bracket projection on the beam web.

If a beam of the type described above is to be used for the purpose for which it is intended, it must have considerable strength. The beam must be capable of withstanding impacts. This is more important than the requirements for compressive or tensile strength. Impact resistance can be achieved by selecting a suitable reinforcement. Experience has shown that the desired impact resistance cannot be obtained solely through the use of metallic reinforcement of conventional type. Welded finely meshed reinforcement must be used and the concrete must also be reinforced by means of glass fibres. These glass fibres need not necessarily be of alkali-resistent type (alkali-resistance being normally required for avoiding a reduction in strength in concrete of considerable age). This will be obvious from the description to be provided later of the method proposed here. It is, however, an advantage if alkali-resistent glass fibres are used.

The width of the beam at the flanges is wider than the width of the beam at the slides face at least along portions of the beam.

Figure 2:
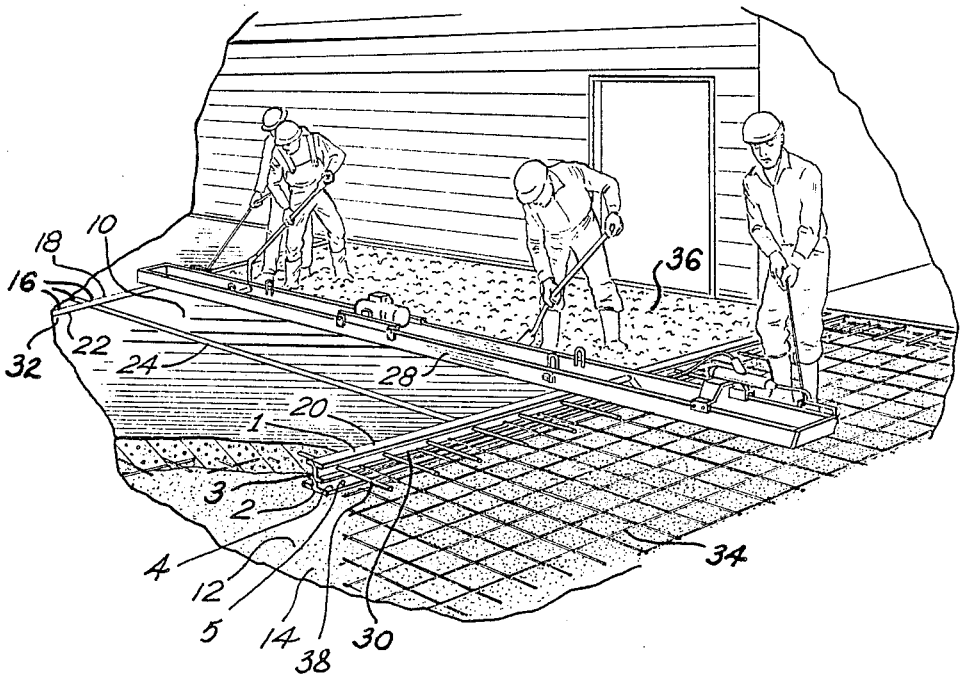
FIG. 2 of the accompanying drawing is perspective view of a concrete floor being laid according to the invention.

As shown in FIG. 2, and briefly described above, the beams of FIG. 1 are used in the laying of a concrete floor, such as floor 10, in a concrete floor area, such as floor area 12, over a base, such as hardened base 14. Beginning the laying of floor 10, a plurality of the beams 16 are located in the concrete floor area 12 to rest on the base 14. The beams 16 are so located in a pattern in which the beams 16 form at least two sides each, such as sides 18, 20, of a plurality of rectangles, such as rectangle 22, in the area 12. As desired, and as shown in FIG. 2, the other sides of each rectangle, such as side 24 of rectangle 22, may also be formed of beams 16. The beams 16 are placed with their anchoring surfaces 2 on the base 14, and their slide face surfaces 1 exposed to carry screeds, such as screed 28. The beams 16 are spaced in the pattern for supporting screeds, such as screed 28, during screeding, on pairs of such beams, such as beams 30, 32.

After the beams 16 are so located, the beams 16 are leveled and anchored securely to the base 14, with bolts or screws, for example (not shown). The beams are leveled and anchored in their pattern, as described above.

If desired, and as shown, welded mesh reinforcements, such as reinforcements 34, are then placed in the rectangles, such as rectangle 22, in the floor area 12. Also if desired and as shown, the reinforcements 34 are fastened to the protruding brackets 3 on the beam webs, as on beams 30, 32. Further as desired and shown, dowels such as dowel 38, are placed through the horizontal holes of the beams, such as beams 30, 32. The dowels will connect adjacent rectangles of poured concrete, to reduce movement between the sections.

Pourable concrete, such as concrete 36, is then poured into the rectangles formed by the pattern of beams, such as the rectangle 22. The concrete is not poured in the rectangles in a checkerboard pattern, but in adjacent rectangles such that the entire floor is laid in a single progression.

Screeds, such as the screed 28, are then placed on the beams forming the sides of the rectangles, such as beams 30, 32. The screeds are operated to vibrate and level the poured concrete in the rectangles. During this screeding operation, the screeds are supported on the beams 16.

Upon the completion of screeding, the poured concrete is allowed to harden to become the hardened concrete floor 10, with the beams 16 remaining in the pattern in which they were placed. The beams remain in position after the hardening, becoming a part of the hardened floor 10 along with the poured concrete.

Thus, the beam described above is used in a way which is already well known but the difference involved here is that the material of the beams is of such a nature that the beam can remain in position after the work has been carried out. The term "concrete" is not limited to cementitious concrete. The term "hardening" is synonomous with the term "curing". Any risk of corrosion is completely eliminated, particularly if care is taken in manufacturing the beam to ensure that the metallic reinforcement does not come too near the surface.

Consequently, it is not necessary to move the screed guide support, as is usually the case. This means considerable gains in time and, therefore, in cost.

Nor is there any longer any obstacle to concreting the entire floor in one day. This entails a marked reduction in the time required.

We claim:

1. A method of producing a concrete floor over a base of material such as sand with at least (a) pourable concrete, (b) a plurality of combination concrete forming and screed guiding beams, the beams being formed of at least precast concrete, and each having flanges, a beam web and a slide face, the flanges being adapted to be anchored to the base, the beam web joining the flanges and side face the slide face adapted to support a screed and become a part of the concrete floor surface, the width of the beam at the beam web being narrower than the width of the beam at the flanges at least along portions of the beam and narrower than the width of the beam at the slide face along portions of the beam, the width of the beam at the flanges being wider than the width of the beam at the slide face at least along portions of the beam and (c) a concrete screed, the method comprising the steps of:

first, locating the plurality of beams in a pattern over the base of material such as sand, with the flanges down in relation to the slide faces, the beams being spaced in the pattern at distances for pairs of the slide faces supporting the screed during screeding;

second, levelling the beam slide faces at heights such that the slide faces are coplanar with the desired concrete floor surface and anchoring the flanges of the plurality of beams in the pattern on the base of material such as sand with the beam slide faces maintained at said heights;

third, pouring the concrete among the plurality of beams in the pattern over the base in sufficient quantity to fill among the beams to the heights of the slide faces;

fourth, screeding the poured concrete among the beams in the pattern to the heights of the slide faces with the screed supported during the screeding on pairs of slide faces of the beams in the pattern; and fifth, hardening the poured and screed concrete into a hardened concrete floor having a hardened concrete floor surface while maintaining the plurality of beams in the pattern during hardening, and hardening the plurality of beams into the floor and thereby causing the plurality of beams to become a permanent loadbearing part of the hardened concrete floor and causing the beam slide faces to become a permanent part of the hardened concrete floor surface whereby the plurality of beams are not removed, which reduces the time and therefore the cost of producing the concrete floor.

2. A method of producing a concrete floor as in claim 1 in which the first, beam locating step further comprises locating the plurality of beams in a pattern, with the pattern being a pattern of rectangles and the beams forming at least two sides of the rectangles.

3. A method of producing a concrete floor as in claim 2 in which the first, beam locating step further comprises locating the plurality of beams in the pattern, the beams being spaced for support of the screed during screeding on successive pairs of the beams.

4. A method of producing a concrete floor as in claim 1 with a floor surface in which the beams have top surfaces, the fifth, hardening step further comprising hardening the poured and screeded concrete into a hardened concrete floor with the top surfaces of the beams becoming parts of the floor surface.

5. A method of producing a concrete floor as in claim 4 in which the fourth, screeding step further includes screeding the poured concrete level with the top surfaces of the beams.

6. A method of producing a concrete floor as in claim 1 further comprising the step of placing reinforcements for the pourable concrete among the plurality of beams in the pattern before the concrete is poured.

7. A method of producing a concrete floor as in claim 6 in which the beams include bracket projections for placement thereon of the reinforcements, the step of placing reinforcements further comprising placing the reinforcements on the bracket projections.

* * * * *